US009949019B2

(12) United States Patent
Akino

(10) Patent No.: US 9,949,019 B2
(45) Date of Patent: Apr. 17, 2018

(54) MICROPHONE

(71) Applicant: Hiroshi Akino, Tokyo (JP)

(72) Inventor: Hiroshi Akino, Tokyo (JP)

(73) Assignee: KABUSHIKI KAISHA AUDIO-TECHNICA, Tokyo (JP)

( * ) Notice: Subject to any disclaimer, the term of this patent is extended or adjusted under 35 U.S.C. 154(b) by 0 days.

(21) Appl. No.: 15/055,682

(22) Filed: Feb. 29, 2016

(65) Prior Publication Data

US 2016/0353201 A1 Dec. 1, 2016

(30) Foreign Application Priority Data

May 26, 2015 (JP) ..... 2015-106401

(51) Int. Cl.
*H04R 1/02* (2006.01)
*H04R 1/34* (2006.01)
*H04R 1/28* (2006.01)

(52) U.S. Cl.
CPC ..... *H04R 1/342* (2013.01); *H04R 1/2876* (2013.01)

(58) Field of Classification Search
USPC ..... 381/361
See application file for complete search history.

(56) References Cited

U.S. PATENT DOCUMENTS 4,789,044 A * 12/1988 Akino ..... H04R 1/38 181/158
5,933,510 A * 8/1999 Bryant ..... H04R 1/00 381/313
7,627,132 B2 * 12/2009 Anderson ..... H04R 1/086 381/356

FOREIGN PATENT DOCUMENTS

JP 5-336588 12/1993

* cited by examiner

*Primary Examiner* — Amir Etesam
(74) *Attorney, Agent, or Firm* — Whitham, Curtis & Cook

(57) ABSTRACT

A microphone includes a tubular first and second acoustic tubes configured with a gap between the second acoustic tube and an inner side of the wall surface of the first acoustic tube. A first opening portion is provided in a wall surface of the first acoustic tube. A second opening portion is provided in a wall surface of the second acoustic tube. A microphone unit is provided inside the second acoustic tube and is configured to acquire sound waves from outside the microphone. A sound wave introduction path formed by the first opening portion, the gap, and the second opening portion, is configured to transmit the sound wave from the outside to the microphone unit.

15 Claims, 9 Drawing Sheets

MICROPHONE

BACKGROUND OF THE INVENTION

Technical Field

The present invention relates to a microphone.

Background Art

In a narrow directional microphone including an acoustic tube, a phase difference between a sound wave entering through a front end of the acoustic tube and a sound wave entering through an opening portion of a tube wall interferes in front of (at a front surface side of) a diaphragm, so that narrow directivity can be obtained. An acoustic resistance material is stuck to the opening portion.

Further, in the narrow directional microphone, a sound collecting angle can be designed to be relatively narrow when a long acoustic tube is included, and the sound collecting angle can be designed to be relatively wide when a short acoustic tube is included. That is, the length of the acoustic tube of the narrow directional microphone is determined in accordance with a state of a sound source. In the narrow directional microphones, when an acoustic resistance value of the opening portion existing in the tube wall of the acoustic tube is adjusted, the sound collecting angle is changed.

JP 5-336588 A describes a technology regarding a variable directional microphone including a first acoustic tube in which a sound hole is covered with an acoustic resistance material, and a second acoustic tube including an opening portion and inserted into an inside of the first acoustic tube in a closely attached manner.

SUMMARY OF INVENTION

As the acoustic resistance material of the narrow directional microphone, a fibrous material such as a net or non-woven fabric is used. When the acoustic resistance material absorbs moisture, the fabric is expanded and the acoustic resistance value is increased. In the narrow directional microphone, if the acoustic resistance value of the acoustic resistance material is excessively increased, the interference of the sound waves in front of the diaphragm due to the phase difference cannot be obtained, and the narrow directivity may be impaired. That is, in the narrow directional microphones, the acoustic resistance value is changed due to the humidity of an environment to be in use, and a constant directional characteristic cannot be obtained.

An object of the present invention is to provide a microphone that can obtain a constant directional characteristic without being influenced by the environment in which it is used.

According to an aspect of the present invention, there is provided a microphone including: a tubular first acoustic tube; a first opening portion provided in a wall surface of the first acoustic tube; a tubular second acoustic tube, wherein the first acoustic tube and the second acoustic tube are configured to provide a gap between the second acoustic tube and an inner side of the wall surface of the first acoustic tube; a second opening portion provided in a wall surface of the second acoustic tube; a microphone unit provided inside the second acoustic tube, and configured to acquire a sound wave from an outside of the microphone; and a sound wave introduction path formed by the first opening portion, the gap between the second acoustic tube and the inner side of the wall surface of the first acoustic tube, and the second opening portion, wherein the sound wave introduction path is configured to transmit the sound wave from the outside of the microphone to the microphone unit.

DESCRIPTION OF THE PREFERRED EMBODIMENTS

Hereinafter, embodiments of a microphone according to the present invention will be described with reference to the drawings.

Figure 1:
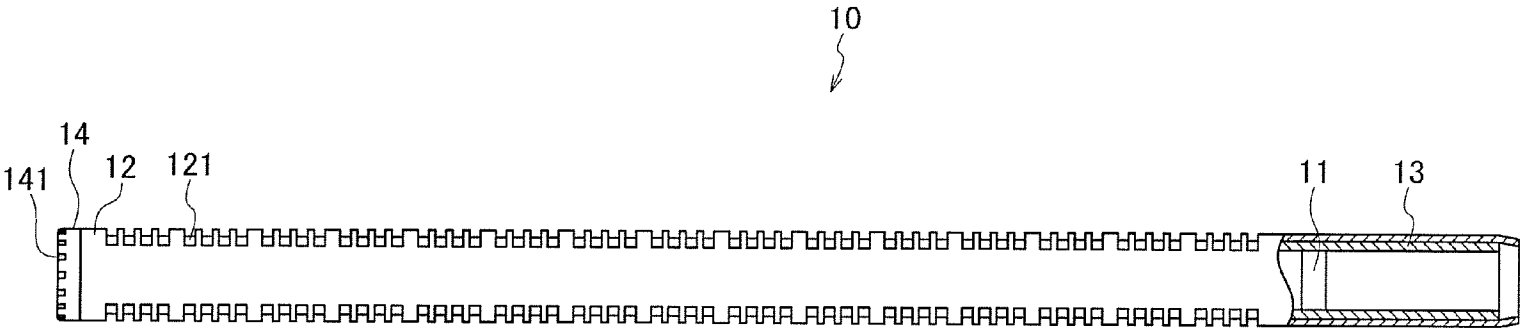
FIG. 1 is a partial sectional view of a side surface illustrating an embodiment of a microphone according to the present invention.

As illustrated in FIG. 1, a microphone 10 of the present embodiment includes a microphone unit 11 that includes a diaphragm and acquires a sound wave from an outside, and tubular first acoustic tube 12 and second acoustic tube 13, insides, that is, interiors of which are hollow. The second acoustic tube 13 is provided inside the first acoustic tube 12. The microphone unit 11 is provided inside and near one of open ends of the second acoustic tube 13 (hereinafter, the one of the open ends is referred to as "rear end"). Further, the microphone 10 includes a front cover 14 provided with a front-side opening portion 141 in an open end at an opposite side to a rear open end of the first acoustic tube 12 (hereinafter, the open end at an opposite side is referred to as "front end").

The microphone 10 can obtain narrow directivity by a phase difference between the sound wave entering through the front-side opening portion 141, and the sound waves entering through opening portions provided in the first acoustic tube 12 and the second acoustic tube 13 and described below. That is, in the microphone 10, the sound wave entering through the front-side opening portion 141, and the sound waves entering through opening portions 121 and 131 described below interfere with each other in front of the diaphragm in the microphone unit 11, so that the narrow directivity is obtained. Such a microphone 10 is typically referred to as shotgun microphone.

Figure 2:
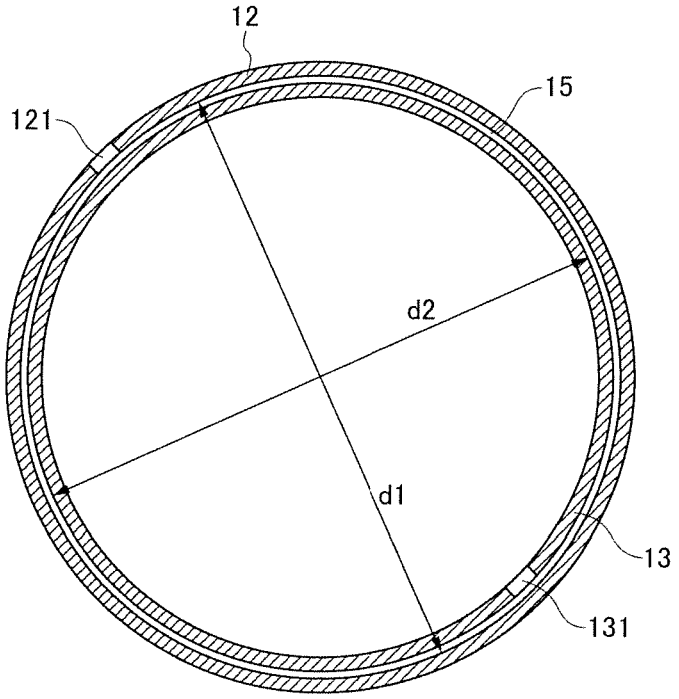
FIG. 2 is a front sectional view illustrating an example of a first acoustic tube and a second acoustic tube of the microphone of FIG. 1.

As illustrated in FIG. 2, an outer diameter d2 of the second acoustic tube 13 is smaller than an inner diameter d1 of the first acoustic tube 12. Therefore, the second acoustic tube 13 can be inserted into the inside of the first acoustic tube 12. An acoustic resistance material is not provided between the first acoustic tube 12 and the second acoustic tube 13, and only a gap 15 is included. A width of the gap 15 is defined by a difference in dimension between the outer diameter d2 of the second acoustic tube 13 and the inner diameter d1 of the first acoustic tube 12. The width of the gap 15 is set to cause a thin resistance layer of air between an inner wall of the first acoustic tube 12 and an outer wall of the second acoustic tube 13.

The first opening portion 121 is provided penetrating a wall surface of the first acoustic tube 12. Further, the second opening portion 131 is provided penetrating a wall surface of the second acoustic tube 13.

Figure 3:
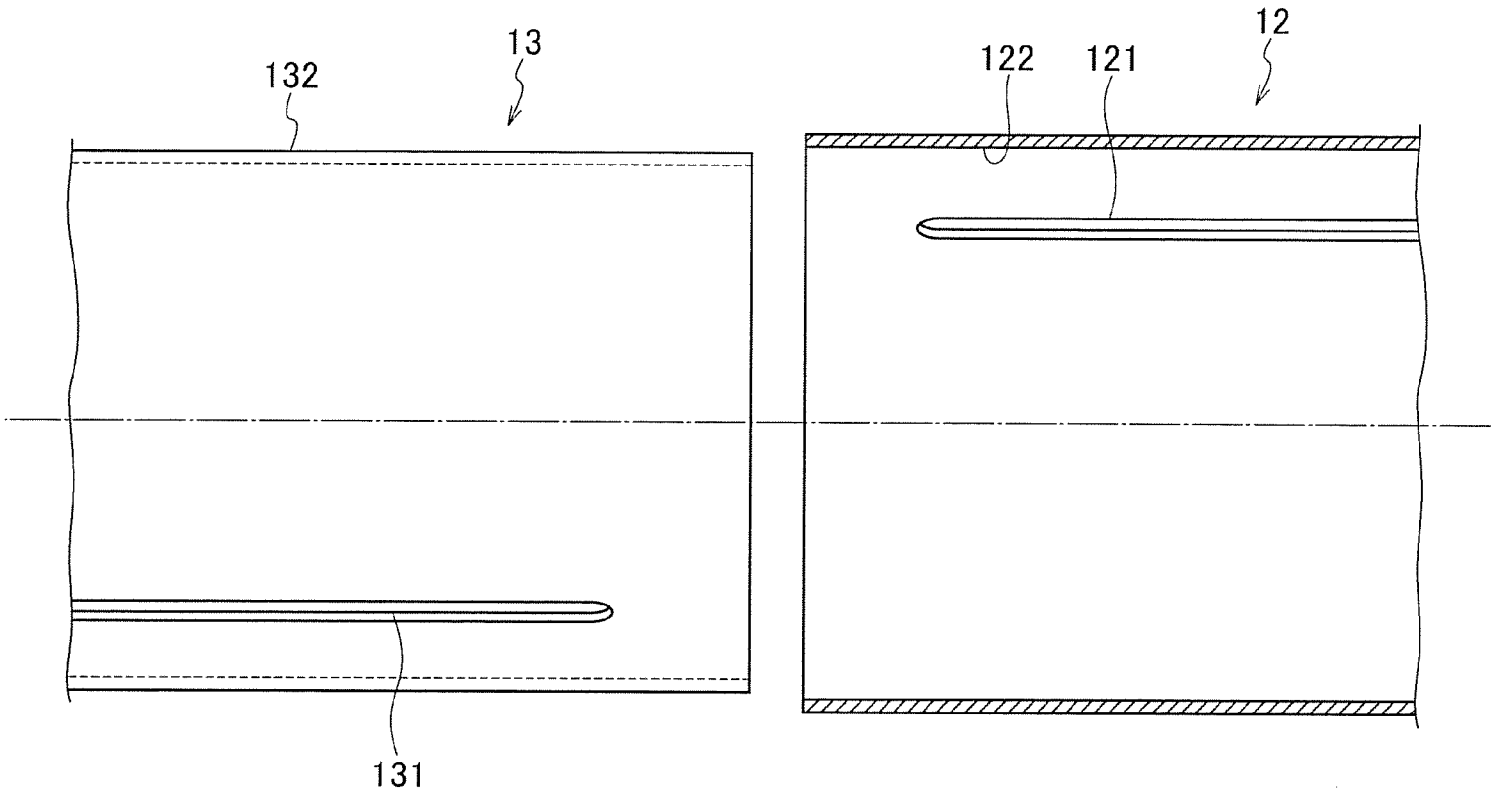
FIG. 3 is a side view illustrating an example of the first acoustic tube and the second acoustic tube of the microphone of FIG. 1.

As illustrated in FIG. 3, the first opening portion 121 has a long hole shape provided in a longitudinal direction of the first acoustic tube 12. Further, the second opening portion 131 also has a long hole shape in a longitudinal direction of the second acoustic tube 13.

The gap 15 is provided between the first opening portion 121 and the second opening portion 131, and the air, that is, the sound wave can be circulated. Therefore, the sound wave from the outside of the first acoustic tube 12 is introduced into the inside of the second acoustic tube 13 through the first opening portion 121, the gap 15, and the second opening portion 131. That is, in the microphone 10, a sound wave introduction path that transmits the sound wave from the outside into the inside of the second acoustic tube 13 through the first opening portion 121, the gap 15, and the second opening portion 131 is formed. The sound wave transmitted into the inside of the second acoustic tube 13 is transmitted to the diaphragm of the microphone unit 11 illustrated in FIG. 1.

In the gap 15, a boundary layer of air is formed in the inner wall of the first acoustic tube 12 and the outer wall of the second acoustic tube 13, so that a thin air resistance layer that serves as an acoustic resistance is caused. The resistance caused in the gap 15 is a viscous resistance layer caused between the air, and an outer wall 132 of the second acoustic tube 13 and an inner wall 122 of the first acoustic tube 12. The acoustic resistance value of the viscous resistance layer by the air in the gap 15 is not changed due to change of the humidity in the air, which is different from the fibrous material using a net or non-woven fabric.

Therefore, the microphone 10 can obtain a constant acoustic resistance without being influenced by an environment to be in use. That is, the microphone 10 can obtain a constant directional characteristic without being influenced by an environment to be in use.

Figure 4:
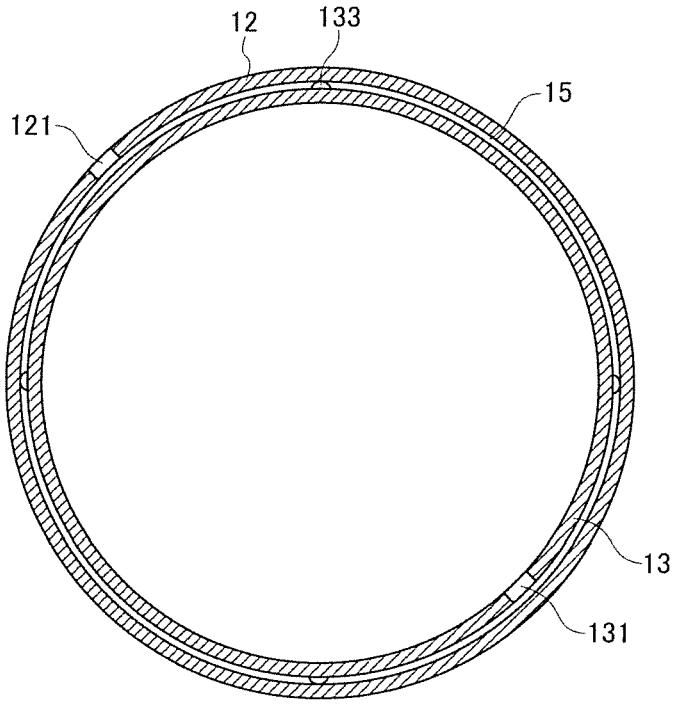
FIG. 4 is a front sectional view illustrating another example of the first acoustic tube and the second acoustic tube of the microphone of FIG. 1.
Figure 5:
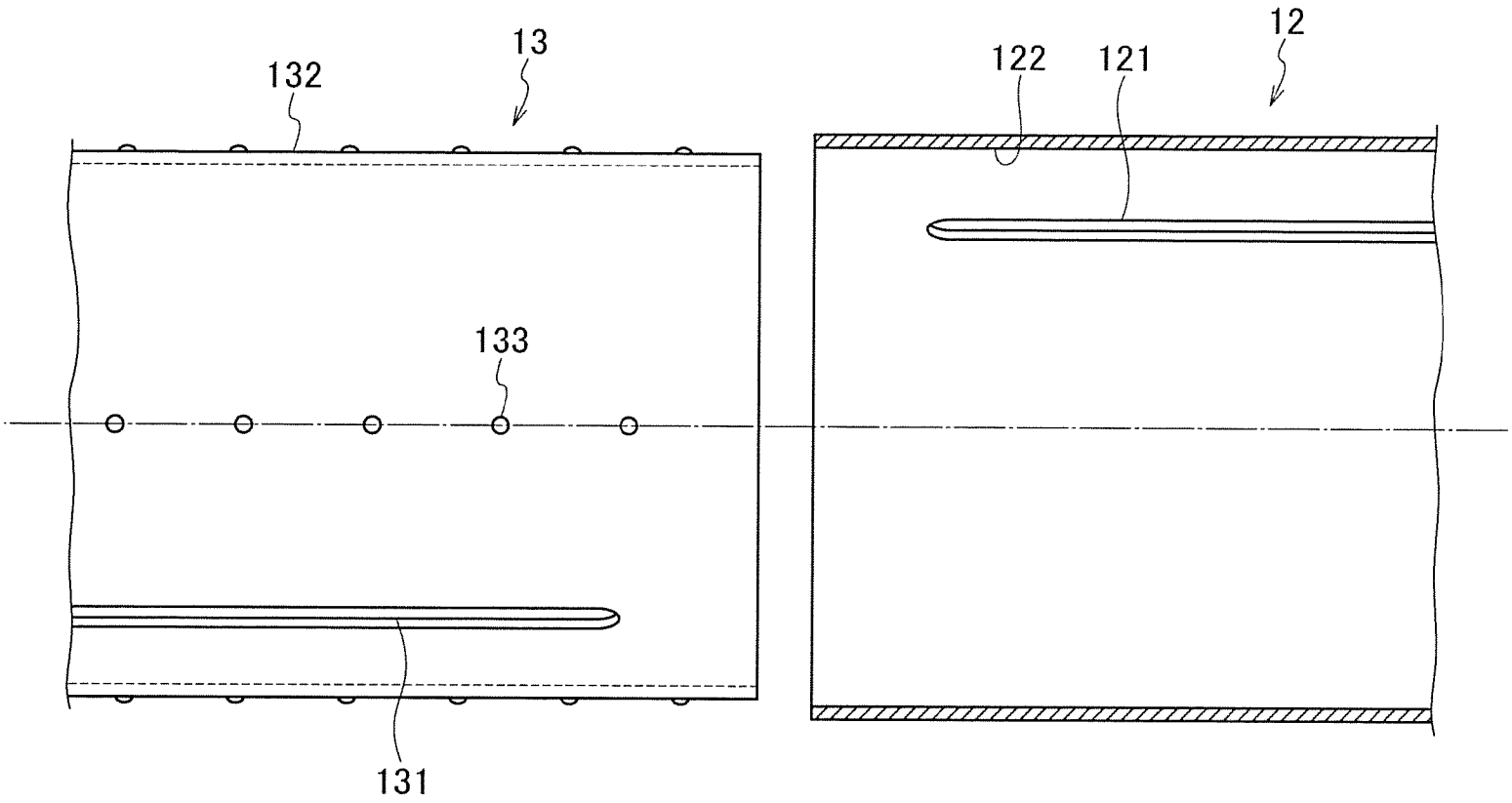
FIG. 5 is a side view illustrating another example of the first acoustic tube and the second acoustic tube of the microphone of FIG. 1.

Further, as illustrated in FIGS. 4 and 5, projecting portions 133 as gap maintaining members that maintain a distance of the gap 15 existing between the first acoustic tube 12 and the second acoustic tube 13 may be included on a tube wall of the first acoustic tube 12 or the second acoustic tube 13.

The projecting portions 133 may just be provided on at least one of the inner wall 122 of the first acoustic tube 12 and the outer wall 132 of the second acoustic tube 13. The projecting portions 133 can be formed by printing a resin material or the like on the inner wall 122 of the first acoustic tube 12 or the outer wall 132 of the second acoustic tube 13. Further, when a material is poured into a mold to form the first acoustic tube 12 and the second acoustic tube 13, such as resin mold, a mold that can form the projecting portions 133 may just be created.

By including the projecting portions 133, the microphone 10 can maintain a space of the gap 15, and thus can more stably obtain the constant acoustic resistance without being influenced by an environment to be in use.

Figure 6:
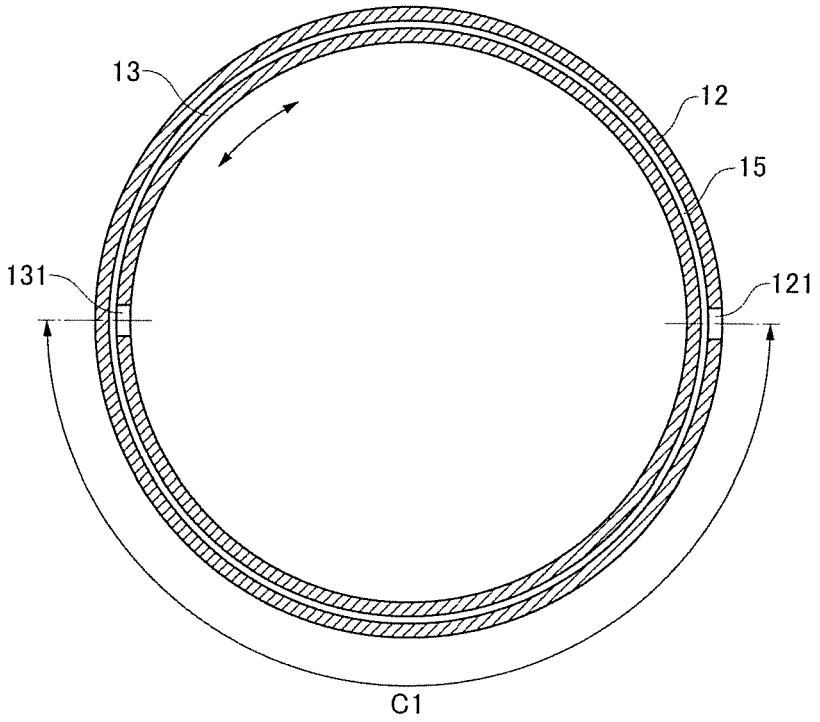
FIG. 6 is a front sectional view illustrating an example of positions of a first opening portion, a second opening portion, and a sound wave introduction path of the microphone of FIG. 1.
Figure 7:
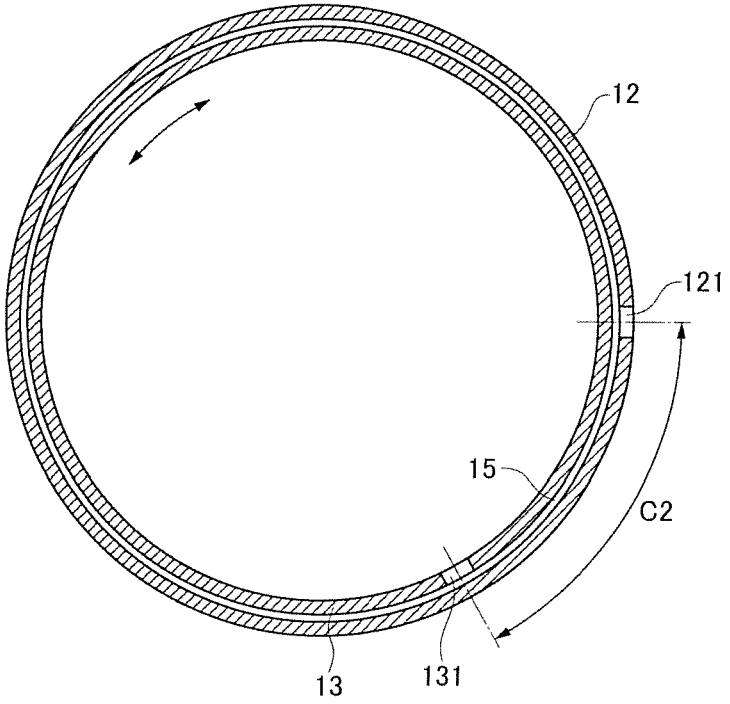
FIG. 7 is a front sectional view illustrating another example of the positions of the first opening portion, the second opening portion, and the sound wave introduction path of the microphone of FIG. 1.

As illustrated in FIG. 6, the first acoustic tube 12 may be rotatable with respect to the second acoustic tube 13 in a peripheral direction (the direction of the arrows) of the wall surface. The first acoustic tube 12 is rotatable with respect to the second acoustic tube 13, so that a length C1 of the sound wave introduction path caused by the gap 15 can be changed like a length C2 illustrated in FIG. 7, for example. The lengths C1 and C2 of the sound wave introduction path are the length between the first opening portion 121 and the second opening portion 131 along peripheries of the first and second acoustic tubes 12 and 13.

The length of the sound wave introduction path influences the acoustic resistance value of the microphone 10, that is, the sound collecting angle. Therefore, in the microphone 10, by changing the length of the sound wave introduction path, the sound collecting angle can be changed. As for the sound collecting angle of the microphone 10, when the first opening portion 121 and the second opening portion 131 are in positions separated by 180°, as illustrated in FIG. 6, the acoustic resistance value is larger and the sound collecting angle is narrower than the case of FIG. 7.

Note that the first opening portions 121 may be provided in a plurality of places in the peripheral direction of the wall surface of the first acoustic tube 12. Similarly, the second opening portions 131 may be provided in a plurality of places in the peripheral direction of the wall surface of the second acoustic tube 13.

Figure 8A:
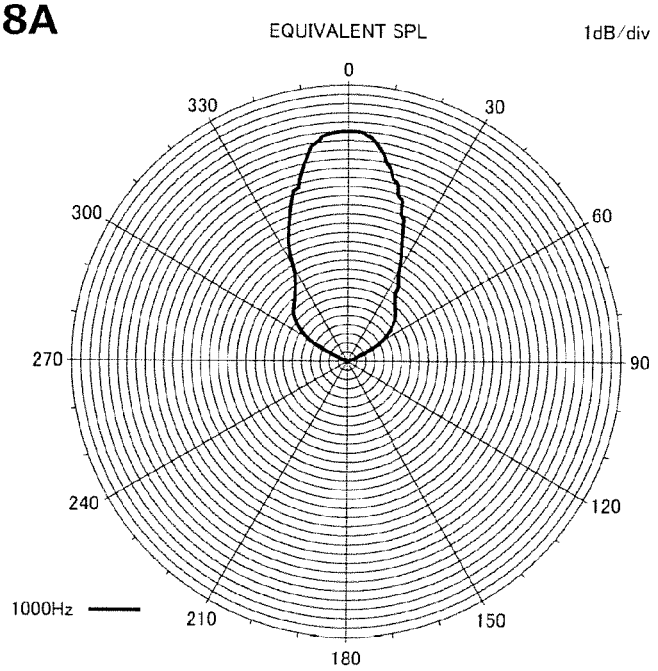
FIG. 8A is a characteristic diagram illustrating a directivity pattern of the microphone of FIG. 1.
Figure 8B:
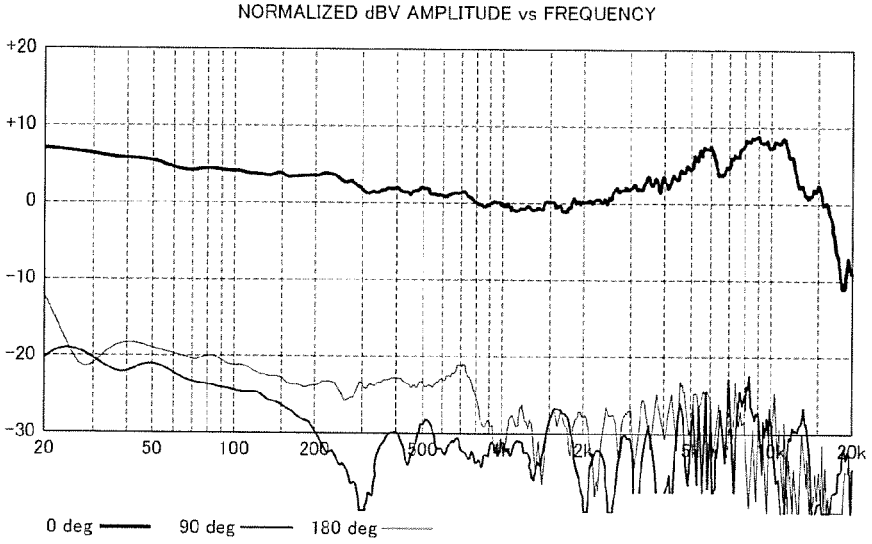
FIG. 8B is a graph illustrating directional frequency characteristics of the microphone of FIG. 1.

A characteristic diagram of a directivity pattern of the microphone 10 is illustrated in FIG. 8A, and a graph of directional frequency characteristics of the microphone 10 is illustrated in FIG. 8B. As can be seen from FIGS. 8A and 8B, the microphone 10 has excellent narrow directivity and directional frequency characteristics in 0° by having the sound wave introduction path by the gap 15 between the first acoustic tube 12 and the second acoustic tube 13.

Figure 9A:
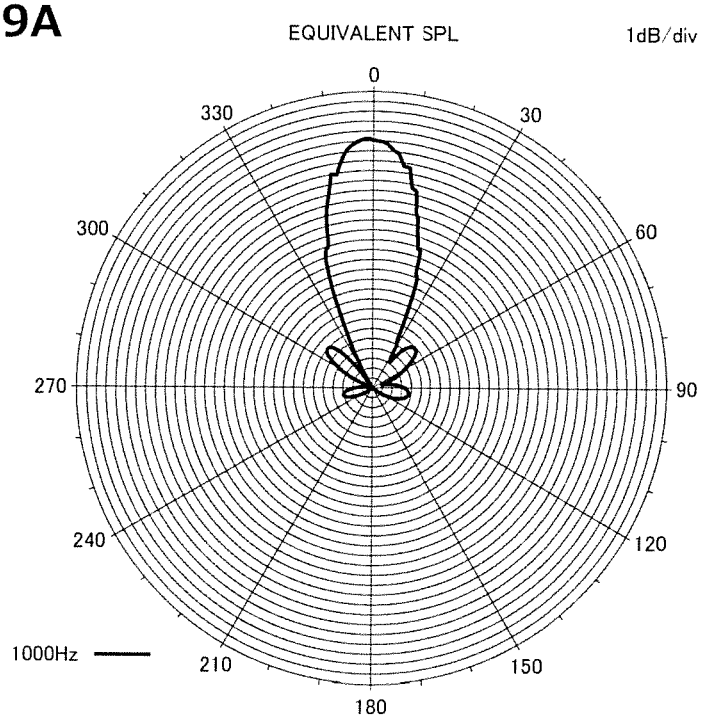
FIG. 9A is a characteristic diagram illustrating a directivity pattern of a microphone of a reference example.
Figure 9B:
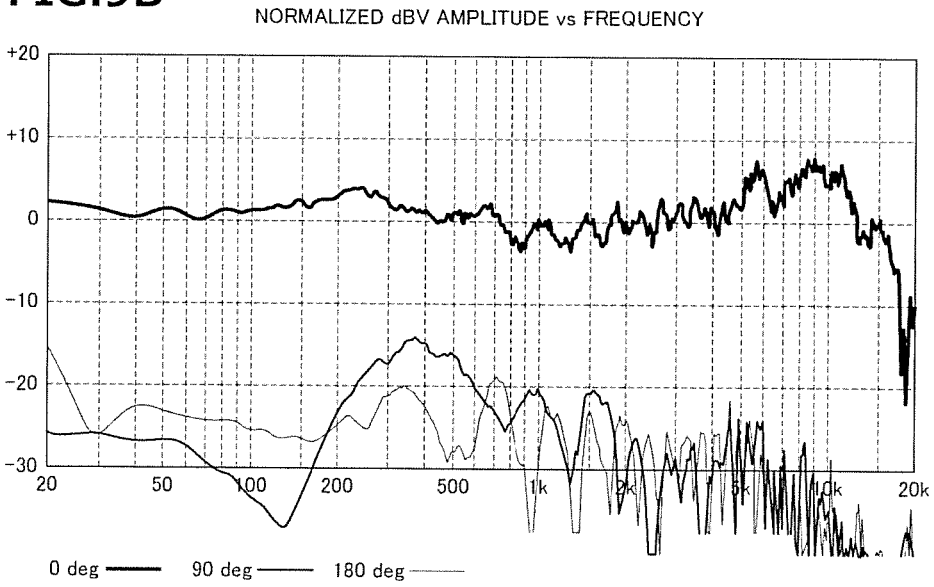
FIG. 9B is a graph illustrating directional frequency characteristics of the microphone of the reference example.

FIG. 9A is a characteristic diagram illustrating a directivity pattern of a microphone of a reference example, and FIG. 9B is a graph illustrating directional frequency characteristics of the microphone of the reference example. The microphone of the reference example has a fibrous acoustic resistance material in a state of containing moisture in opening portions of acoustic tubes.

As illustrated in FIG. 9A, the microphone of the reference example has directivity even in a wider angle than 0°, compared with the directivity pattern of the microphone 10 illustrated in FIG. 8A.

Further, as illustrated in FIG. 9B, in the microphone of the reference example, if the acoustic resistance material contains too much moisture, the acoustic resistance value is excessively increased, and the acoustic tubes become ones without including the opening portions. That is, as illustrated in FIG. 9B, in the microphone of the reference example, only a specific sound range is emphasized, compared with the directional frequency characteristics of the microphone 10 illustrated in FIG. 8B.

As described above, according to the microphone 10 of the present embodiment, the constant acoustic resistance can be obtained without being influenced by an environment to be in use. Therefore, excellent narrow directivity and excellent directional frequency characteristic can be obtained. Further, according to the microphone 10, the sound collecting angle can be changed.

What is claimed is:

1. A microphone comprising:

a tubular first acoustic tube;

first opening portions provided in a wall surface of the first acoustic tube;

a tubular second acoustic tube, wherein the first acoustic tube and the second acoustic tube are configured to provide gap between the second acoustic tube and an inner side of the wall surface of the first acoustic tube;

a second opening portion provided in a wall surface of the second acoustic tube;

a microphone unit provided inside the second acoustic tube, and configured to acquire a sound wave from an outside of the microphone; and a sound wave introduction path formed by the first opening portion, the gap between the second acoustic tube and the inner side of the wall surface of the first acoustic tube, and the second opening portion, wherein the sound wave introduction path is configured to transmit the sound wave from the outside of the microphone to the microphone unit, wherein the outer wall of the second acoustic tube faces all parts in the longitudinal and circumferential directions of the inner wall of the first acoustic tub, wherein the gap is configured to cause a thin air resistance layer serving as an acoustic resistance, and wherein the acoustic resistance occurring in the gap is a viscous resistance.

2. The microphone according to claim 1, wherein a boundary layer of air is formed in the gap, wherein the boundary layer of air functions as an acoustic resistance.

3. The microphone according to claim 1, further comprising gap maintaining members that maintain the gap, wherein the gap maintaining members are included in a plurality of places in a peripheral direction of at least one of an inner wall of the first acoustic tube and an outer wall of the second acoustic tube.

4. The microphone according to claim 1, wherein the first acoustic tube is rotatable with respect to the second acoustic tube in a peripheral direction of the wall surface, and the sound wave introduction path has a length from the first opening portion to the second opening portion which is changeable by rotation of the first acoustic tube.

5. The microphone according to claim 1, wherein the first opening portion is comprised of a plurality of openings provided in a plurality of places in a peripheral direction of the wall surface of the first acoustic tube.

6. The microphone according to claim 1, wherein the second opening portion is comprised of a plurality of openings provided in a plurality of places in a peripheral direction of the wall surface of the second acoustic tube.

7. The microphone according to claim 1, wherein the width of the gap is smaller than a width of first acoustic tube.

8. The microphone according to claim 1, wherein the first opening surfaces are coverless.

9. The microphone according to claim 1, wherein the first opening surfaces are free of non-woven fabrics.

10. The microphone according to claim 1, wherein the microphone excludes non-woven fabrics.

11. The microphone according to claim 1, wherein the microphone is configured to have a constant directional characteristic in different humidities.

12. The microphone according to claim 3, wherein the gap maintaining members are included on a tube wall of the first acoustic tube.

13. The microphone according to claim 3, wherein the gap maintaining members are included on a tube wall of the second acoustic tube.

14. The microphone according to claim 3, wherein the gap maintaining members are arranged in the gap.

15. The microphone according to claim 3, wherein the gap maintaining members comprise a resin material.

* * * * *